US006769147B1

(12) United States Patent
Stubbs

(10) Patent No.: US 6,769,147 B1
(45) Date of Patent: Aug. 3, 2004

(54) MULTI-USE BROAD BLADED KNIFE

(76) Inventor: Shawn Stubbs, 7525 Petersburg, Unit A, Anchorage, AK (US) 99507

( * ) Notice: Subject to any disclaimer, the term of this patent is extended or adjusted under 35 U.S.C. 154(b) by 0 days.

(21) Appl. No.: 10/190,423

(22) Filed: Jul. 3, 2002

(51) Int. Cl.[7] ..... B26B 3/00
(52) U.S. Cl. ..... 7/105; 7/158; 7/165; 30/169
(58) Field of Search ..... 7/105, 158, 165, 7/170, 167; 30/169, 162, 335, 336; 15/236.01; D8/105

(56) References Cited

U.S. PATENT DOCUMENTS

| | | | | | |
|---|---|---|---|---|---|
| 832,455 | A | | 10/1906 | Christensen | |
| 1,552,361 | A | | 9/1925 | Trombley | |
| 1,598,420 | A | * | 8/1926 | Brossett | 7/105 |
| 3,370,307 | A | * | 2/1968 | Beeks | 7/138 |
| 3,774,252 | A | | 11/1973 | Cantales | |
| 5,063,627 | A | * | 11/1991 | Marra | 7/105 |
| 5,511,261 | A | * | 4/1996 | Collins | 7/158 |
| D380,661 | S | | 7/1997 | Lehmann | |
| 5,720,063 | A | | 2/1998 | Chacon | |
| 5,887,306 | A | | 3/1999 | Huang | |
| 5,979,058 | A | * | 11/1999 | Henke | 7/105 |
| 6,006,384 | A | | 12/1999 | Toal | |
| 6,014,785 | A | | 1/2000 | Punch et al. | |
| 6,163,963 | A | * | 12/2000 | Huang | 30/162 |

* cited by examiner

*Primary Examiner*—D. S. Meislin
(74) *Attorney, Agent, or Firm*—Schmeiser, Olsen & Watts, LLP

(57) ABSTRACT

In accordance with the present invention, a multi-use broad bladed knife is provided. The multi-use knife includes a broad blade, such as commonly used to apply spackle to a wall or other surface. The broad blade is attached to a handle, with a striking surface comprised of an appropriate hard material on the heel of the handle. Within the handle are slideably extendable and retractable implements, including a cutting edge and a screwdriver implement. The cutting edge and screwdriver implement may be extended through the heel of the handle through slits using buttons. The screwdriver implement and cutting edge may lock into place when extended for use and may also lock in place when retracted within the handle.

13 Claims, 9 Drawing Sheets

MULTI-USE BROAD BLADED KNIFE

BACKGROUND OF THE INVENTION

1. Field of the Invention

The present invention relates generally to multi-use hand tools. More particular, the present invention relates to broad bladed knives such as those used for drywall construction that includes additional implements within its handle for use during work.

2. Description of the Prior Art

The construction and finishing of drywall constructions, commonly used throughout the United States and the world, requires a variety of tools and implements. During the assembly process, panels of drywall are affixed to support members such as wood or metal studs. If necessary drywall panels may be cut to fit as needed for a wall. Typically, drywall panels are affixed to the support members using screws. After drywall panels have been affixed to the support members, the gaps between abutting drywall panels must be sealed to provide a surface suitable for painting, wallpapering, or the finishing. This process is usually accomplished using putty compounds (sometimes referred to as "spackle" or "mud", terms that will be used interchangeably herein) and special purpose tape. The resulting seams are typically smoothed using sandpaper or other abrasives, with additional putty compound being applied as necessary to provide a surface of appropriate consistency for painting or the application of some other covering.

As one skilled in the art will realize, this process requires several tools. Saws and/or sharp knives may be used to cut drywall panels to fit as needed for a wall. A screwdriver or appropriate drill and bit is required to tighten the screws used to affix drywall panels to support members. The process of filling gaps between drywall panels using appropriate tape and putty requires a sharp bladed knife or razorblade to cut the tape and a broad bladed knife to spread and smooth the putty compound.

One skilled in the art will realize that, while different portions of the assembly process require different tools, the assembly process itself does not always comprise entirely discreet steps. For example, during the process of preparing appropriate seams to fill gaps between adjoining drywall panels, a screw affixing a drywall panel to a support member may require further tightening to prevent it from protruding above the drywall surface. Other tools, such as hammers or other pounding implements, may be needed during the process to flatten threads from the tape that would otherwise prevent an appropriately smooth surface from being obtained. A sharp bladed knife may also be useful to trim drywall panels after they are affixed to the support members, or for trimming excess tape. Meeting this multiplicity of needs with a single tool presents a challenge within the art.

As can be seen from a brief description of the drywall assembly process, multiple tools may be required during the process, which may require a drywaller to carry numerous different tools and to waste time on a job switching between them. This problem of wasting time while switching between tools can be particularly acute while putty compound and tape are being applied to join drywall portions smoothly. During this process, a worker typically uses a broad bladed knife, sometimes referred to as a drywall knife, to spread putty compound into and around the gaps between drywall panels and on screw heads and to smooth the putty initially. As part of this process, the broad blade may engage raised screw heads which will require attention, or stray ends of tape may be detected but require cutting, or threads from the tape may be discovered that will require flattening using a hammer or other pounding tool.

It is the object of this invention to provide a convenient broad bladed knife for use in the application of the putty compound that also incorporates therein a screwdriver, a sharp knife or razorblade, and a surface suitable for pounding. Such a device should secure the cutting edge and screwdriver tip in a fashion that prevents inadvertent engagement with the user, which could cause injury, while further allowing the cutting edge and screwdriver to be easily and quickly accessed. Such a device should also be capable of one handed operation.

SUMMARY OF INVENTION

In accordance with the foregoing, the present invention provides a broad bladed knife for use in applying putty during drywall construction, with a screwdriver, cutting edge such as knife or a razor blade, and pounding surface included integrally with the broad bladed knife. In accordance with one embodiment of the present invention, the pounding surface is included on the heel portion of the handle of the broad bladed knife. The screwdriver and the cutting edge are slidably retracted within the handle of the broad bladed knife.

DETAILED DESCRIPTION OF THE PREFERRED EMBODIMENT

Figure 1:
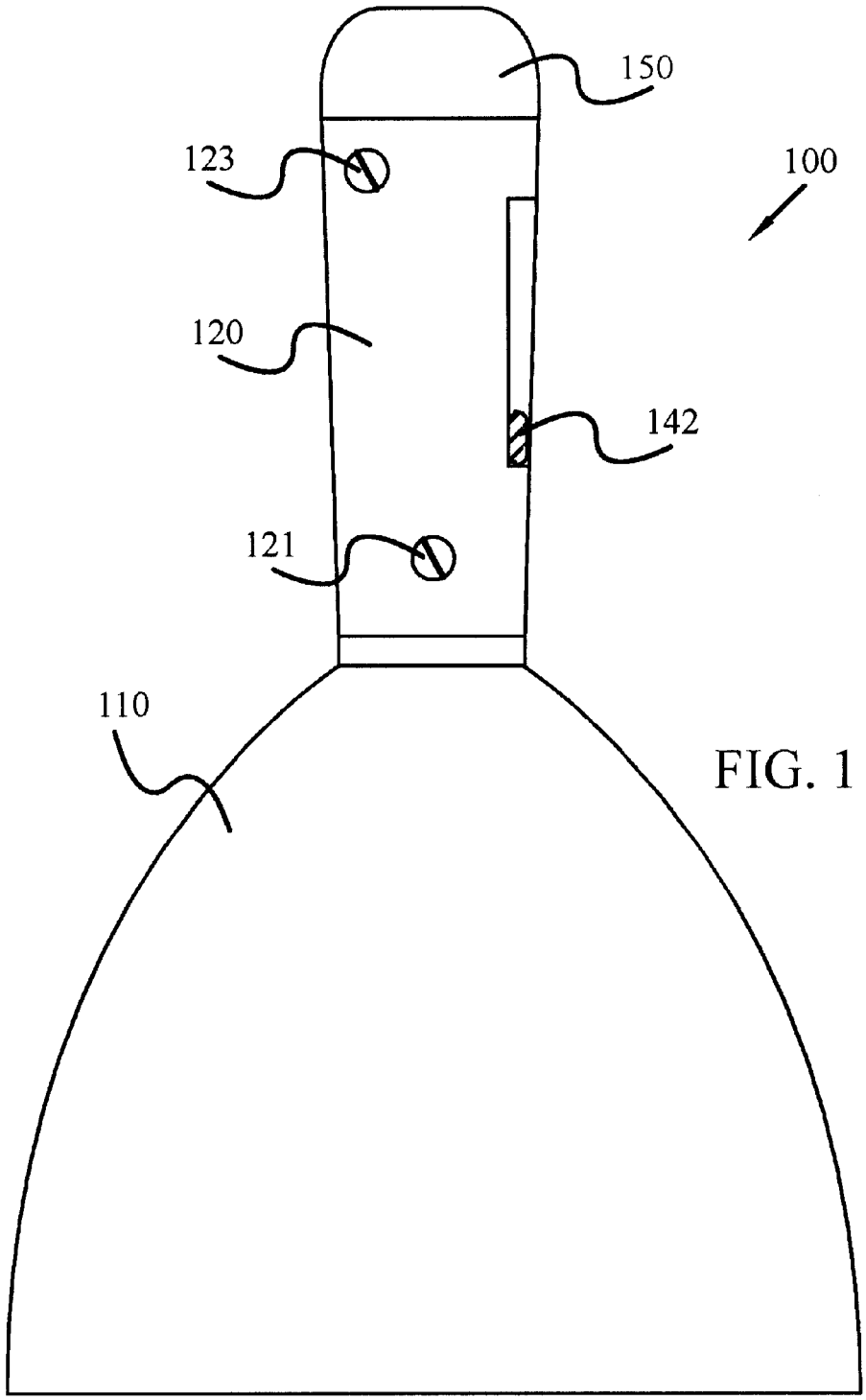
FIG. 1 is a view of a broad bladed knife in accordance with the present invention with the cutting edge and screwdriver retracted.
Figure 2:
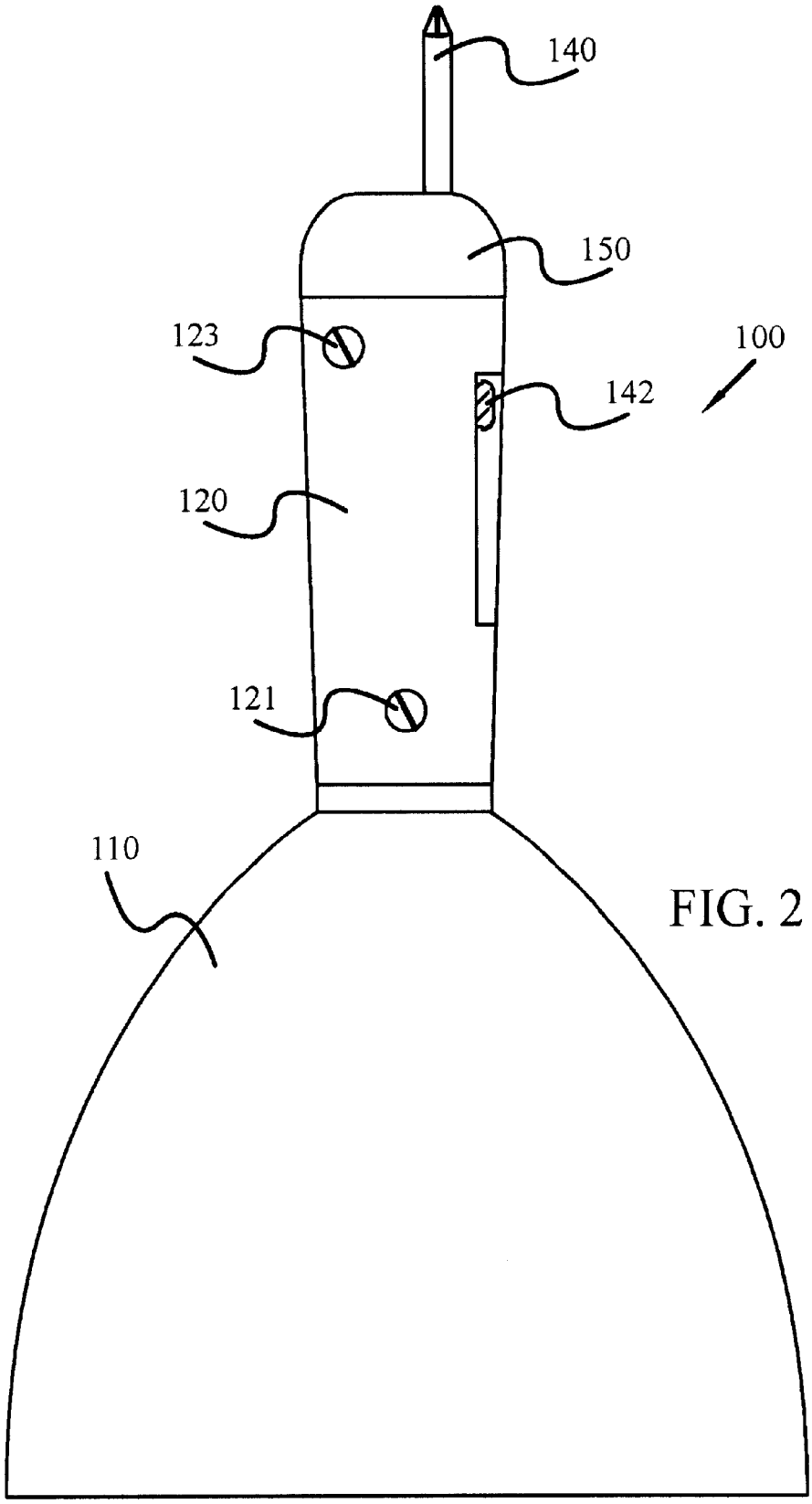
FIG. 2 is a view of a broad bladed knife in accordance with the present invention with the cutting edge and screwdriver extended.
Figure 3:
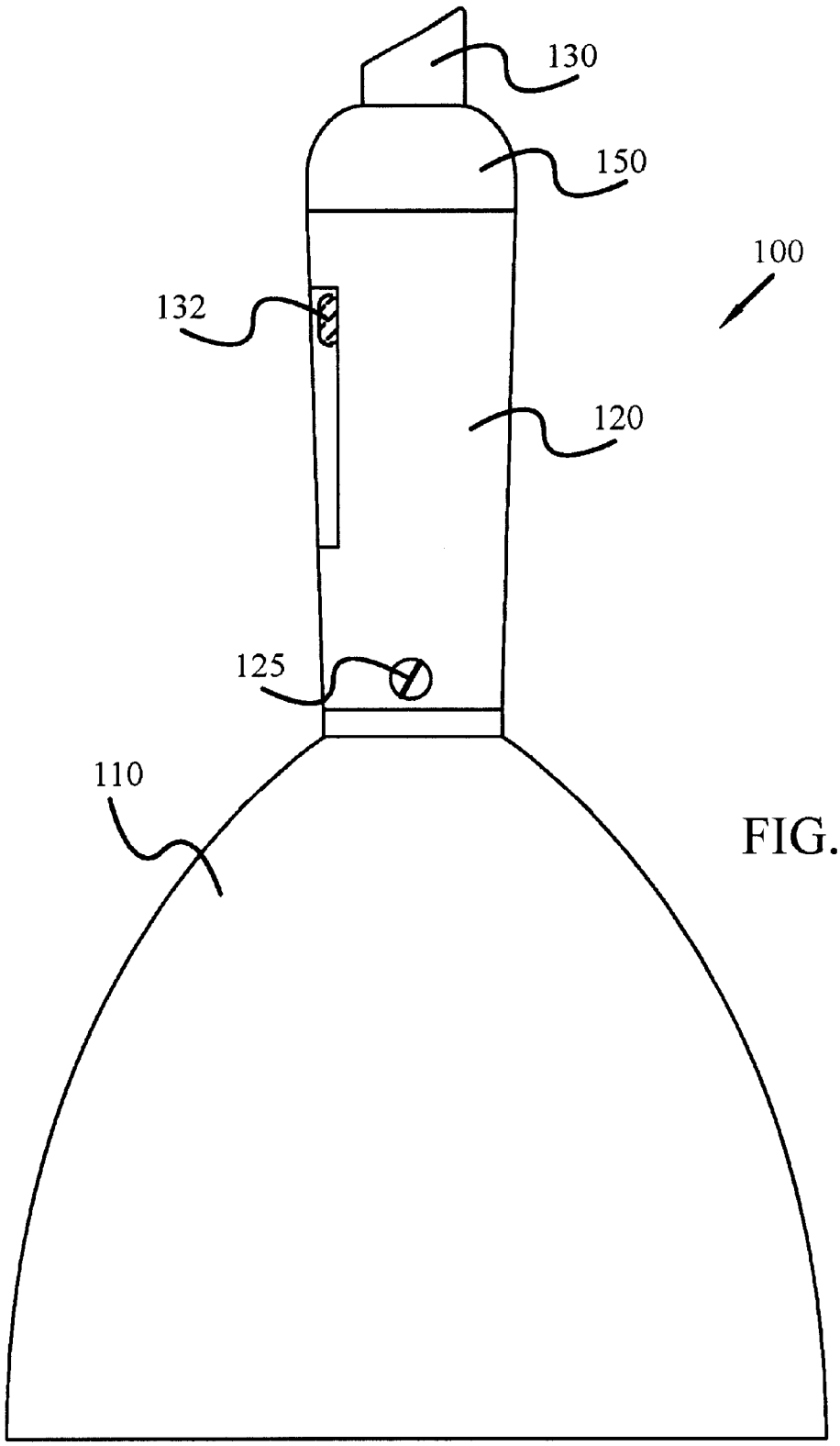
FIG. 3 is a view of a broad bladed knife in accordance with the present invention with the screwdriver extended.

In accordance with the present invention, a broad bladed knife with additional tool implements is provided. Referring now to FIGS. 1–3, the knife assembly 100 includes a broad blade 110 rigidly affixed to a handle 120. The broad blade 110 may be constructed from a suitably rigid and durable metal, although other materials, such as appropriate plastics, could be used. The broad blade 110 may have any desired width, but widths of 2 inches, 3 inches, 4 inches, 5 inches, or 6 inches are appropriate. The handle 120 may be constructed of molded plastic or other materials. The handle 120 may appropriately be molded or cut to fit the form of a users hand.

In accordance with the present invention, a firm pounding surface 150 is rigidly affixed to handle 120 opposite from the broad blade 110. The pounding surface 150 may appropriately be constructed of a hard metal or other sufficiently durable and hard material. Within the handle 120 is contained a cutting edge 130, such as a razor blade and a screwdriver 140. The cutting edge 130 and screwdriver 140 may be slidably retracted and contained within the handle 120 when not in use. Also included may be a first button 132 and a second button 142 accessible from the exterior of the handle 120. The first button 132 is operably connected to the cutting edge 130 and the second button 142 is operably connected to the screwdriver 140. The cutting edge 130 may be extended from the handle 120 by depressing the first button 132 and moving the first button 132 along handle 120 toward the pounding surface 150. The cutting edge 130 may be retracted by depressing the first button 132 and moving the first button 132 along the handle 120 toward the broad blade 110. The screwdriver 140 may be extended and retracted from the handle 120 in a similar fashion using the second button 142.

The operation of the broad bladed knife 100 in accordance with the present invention proceeds as typical while applying putty to a drywall surface. The advantage of the present invention becomes apparent when, in the course of using the broad bladed knife 100, a pounding surface 150, screwdriver 140, or cutting edge 130 is needed. For example, a worker using a broad bladed knife 100 in accordance with the present invention may discover while applying putty using the broad blade 110 that tape threads on the wall require pounding to smooth them. The worker can simply reverse the broad bladed knife 100 and use the pounding surface 150 on the handle 120 to pound those threads. A worker may also discover while applying putty using the broad blade 110 that one or more screws require tightening to bring them below the surface of the wall. The worker may then simply extend the screwdriver 140 from the handle 120 of the broad bladed knife 100 and use it to tighten the screws. Likewise, a worker may determine that a portion of tape or other material needs to be cut to provide an appropriately smooth surface. The worker may then extend the cutting edge 130 from the handle 120 of the knife 100 and use it to cut as needed. At this time, it is worthwhile to note an additional advantage that the knife in accordance with the present invention provides. By disposing the cutting edge 130 and screwdriver 140 retractably within the handle 120, a worker may use all aspects of the present invention with only one hand. For example, a worker holding the broad bladed knife 100 in one hand while applying a putty may reverse the knife to pound, or extend the cutting edge 130 or screwdriver 140 using the first button 132 or second button 142, all with only one hand. This allows the worker to use his other hand to steady himself or to hold other work related items such as a pan of mud or other materials.

Figure 4:
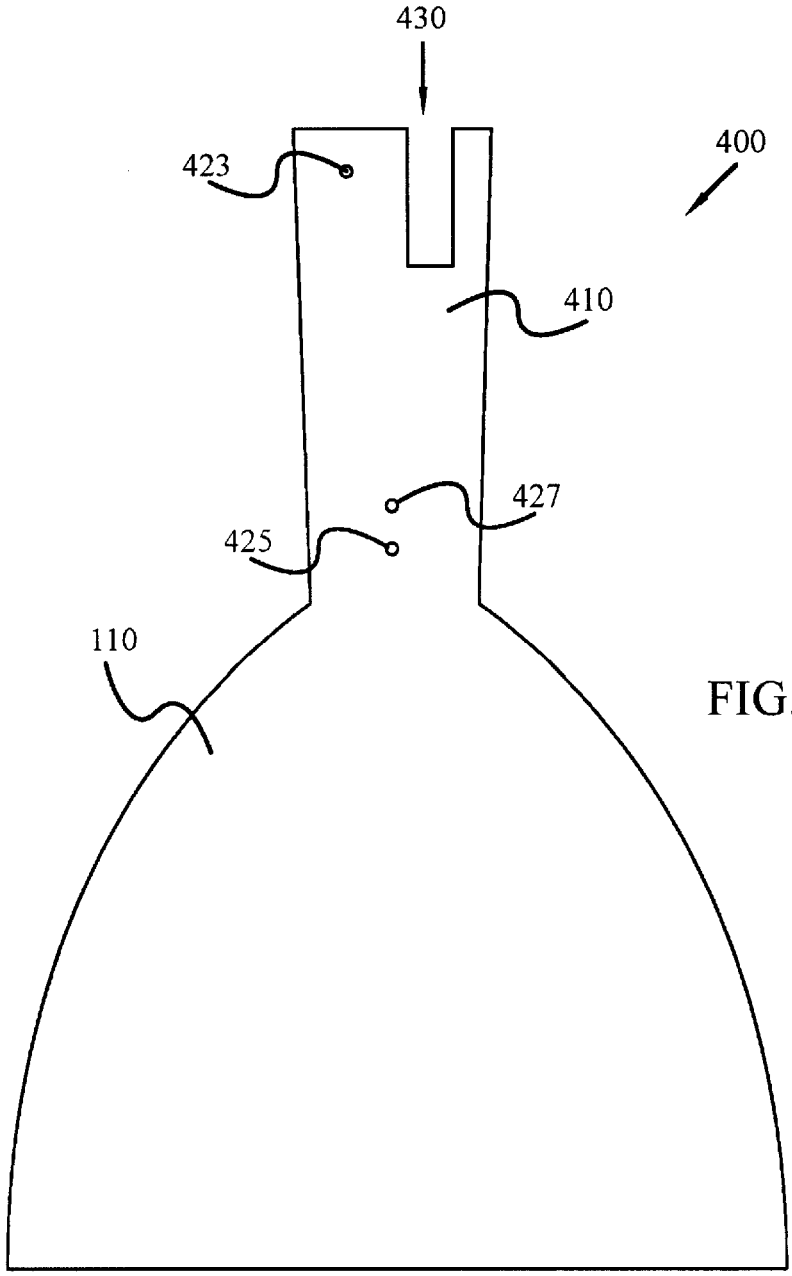
FIG. 4 is a view of a broad blade component suitable for use in the present invention.

Referring now to FIG. 4, the broad blade assembly 400 is shown. The broad blade 110 extends from the handle 120, and is used to apply spackle to a wall surface. The handle extension 410 extends from the broad blade 110 and allows the broad blade assembly 400 to be firmly secured to the handle 120 during use. Screw holes 420, 422, 424 allow screws to be used to firmly affix the broad blade assembly 400 to the handle 120. It should be noted that a notch 430 may be placed within the handle portion 410 to allow the screwdriver assembly 900 to be retracted within the handle 120 without engaging the handle portion 410.

Figure 5:
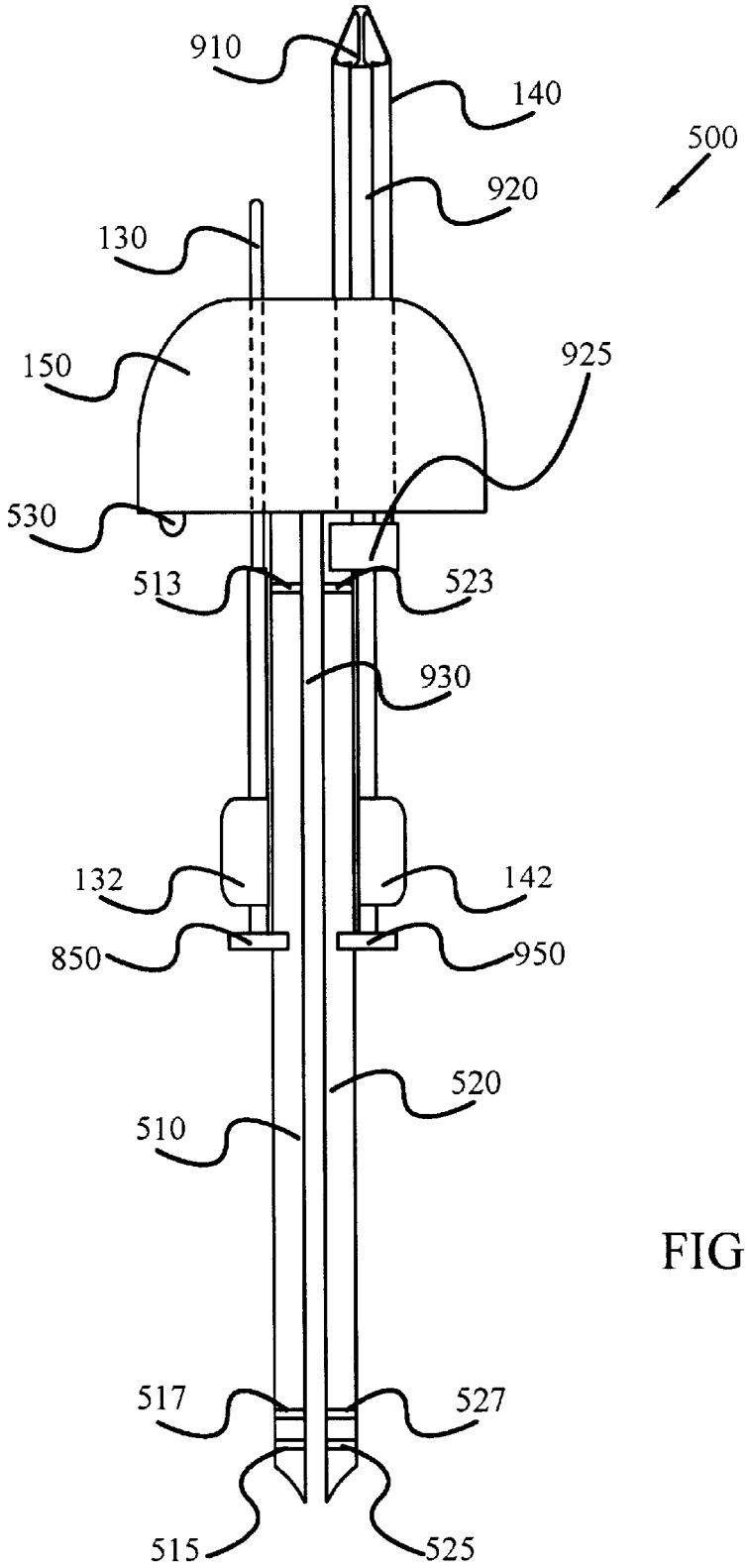
FIG. 5 is a view of pounding surface, cutting edge, and screwdriver assemblies suitable for use with the present invention.
Figure 6:
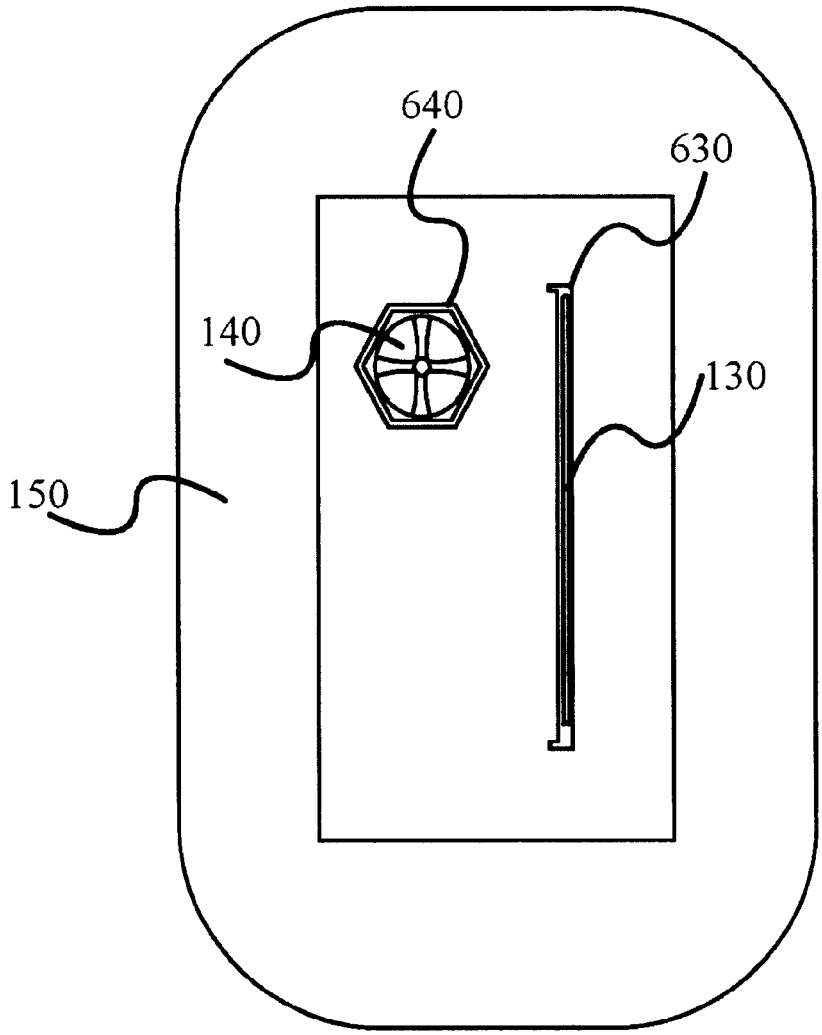
FIG. 6 is a view of the pounding surface.

Referring now to FIG. 5, the heel assembly 500 is illustrated in greater detail. The pounding surface 150 may be constructed of an appropriately durable and hard material to allow it to be used to pound threads or other materials without undue wear. Two extensions 510, 520 extend from the pounding surface 150 to facilitate attaching the pounding surface 150 to the handle 120 of the broad bladed knife 100. Screw holes 513, 515, 517, are included in the first extension .510. The second extension 520 includes. screw holes 523, 525, 527. Screwdriver 140 extends through hole 640 in the pounding surface 150 for use. Likewise, cutting edge 130 extends through slot 630 and pounding surface 150 to be used. A prong 530 extends from the pounding surface 150 to further facilitate the rigidity of the handle 120.

Figure 7:
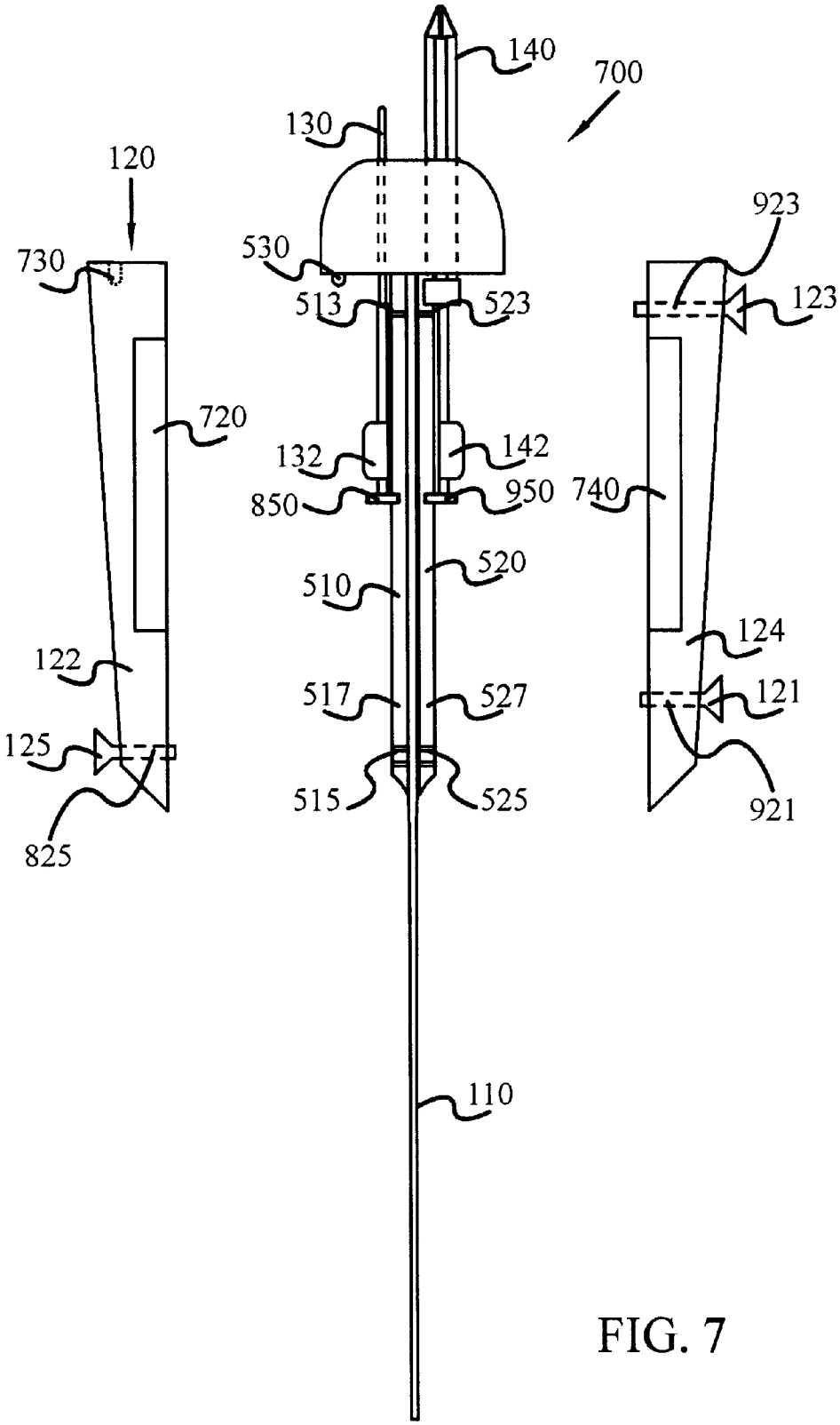
FIG. 7 is an exploded view of the handle of a broad bladed knife in accordance with the present invention.

Referring now to FIG. 7, an exploded view of the handle 120 is shown. The handle 120 includes a first handle portion 122 and a second handle portion 124. The handle extension 410 is dimensioned to fit securely between the first extension 510 and the second extension 520 of the heel assembly 500. The first handle portion 122 includes screw hole 825 and notch 730. Notch 730 engages nub 530 to retain handle portion 122 within the handle 120. Handle portion 122 is also retained within the handle 120 by using screw 125 that extends through and engages screw hole 825 in the first handle portion 122, the screw hole 515 and the first extension 510, the screw hole 425 in the handle extension 410 of the broad blade assembly 400, and the screw hole 525 in the second extension 520. The second handle portion 124 includes screw holes 921, 923. Screw 121 extends through and engages screw hole 921 on the second handle portion 124, screw hole 527 on the second extension 520, screw hole 427 on the handle extension 410 of the broad blade assembly 400, and screw hole 517 of the first extension 510. Screw 123 extends through and engages screw hole 923 on the second handle portion 124, screw hole 523 on the second extension 520, screw hole 423 on the handle extension 410 of the broad blade assembly 400, and screw hole 513 on the first extension 510.

Figure 8:
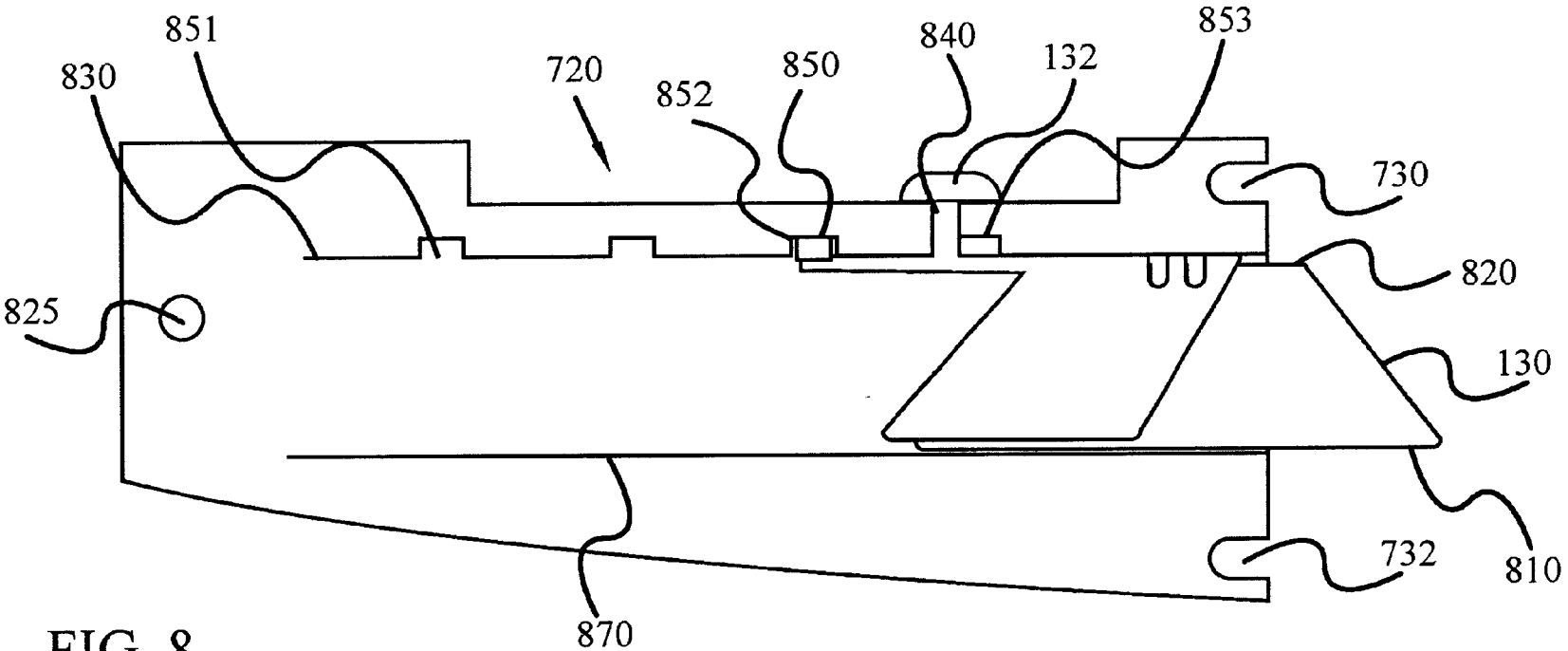
FIG. 8 is a view of the cutting edge assembly.

Referring now to FIG. 8, the first handle portion 122 and the cutting edge assembly 800 are illustrated. Notches 730, 732 in the first handle portion 122 engage nubs 530, not shown of the heel assembly 700. The cutting edge 130 is retained within the first handle portion 122 of the handle 120 when it is retracted. The cutting edge 130 includes a sharpened point 810 and a spine 820. The cutting edge 130 attaches to a flange 830. The flange 830 may typically be made integral with the spine 820, or may be attached using welding, rivets, or adhesives. The flange 830 may appropriately be constructed of a flexible metal, but other materials, including plastics, may be used. The flange 830 includes a prong 850 and a stem 840. The stem 840 extends from the flange 830 and terminates in the first button 132. When the first button 132 is depressed, the stem 840 forces the flange 830 downwards. When the flange 830 is forced downwards, the prong 850 travels downwards as well. The prong 850 may engage a first recess 851 integral to the first handle portion 122. When the prong 850 engages the first recess 851, the cutting edge 130 is retracted completely within the handle 120. When the first button 132 is depressed, the prong 850 is forced downwards from the first recess 851, allowing the entire cutting edge assembly 800 to slide along the length of the first handle portion 122. If the first button 132 is released as the cutting edge assembly 800 slides, the prong 850 will engage a second recess 852 integral to the interior of the first handle portion 122. If the prong 850 engages the second recess 852, the cutting edge 130 will be partially extended from the pounding surface 150 of the handle 120. If the first button 132 is depressed and the cutting edge assembly 800 is slid further along the length of the handle, the prong will engage a third recess 850. When the prong 850 engages the third recess 853, the cutting edge assembly 800 is as fully extended from the pounding surface 150 of the handle 120 as permitted by the construction of the broad bladed knife in accordance with the present invention. Optionally, a greater number of recesses may be provided if a greater degree of adjustment of the extension of the cutting edge 130 is desired. It should be further noted that a groove 870 within the interior of the first handle portion 122 holds the cutting edge 130 as it slides within the first handle portion 122.

Figure 9:
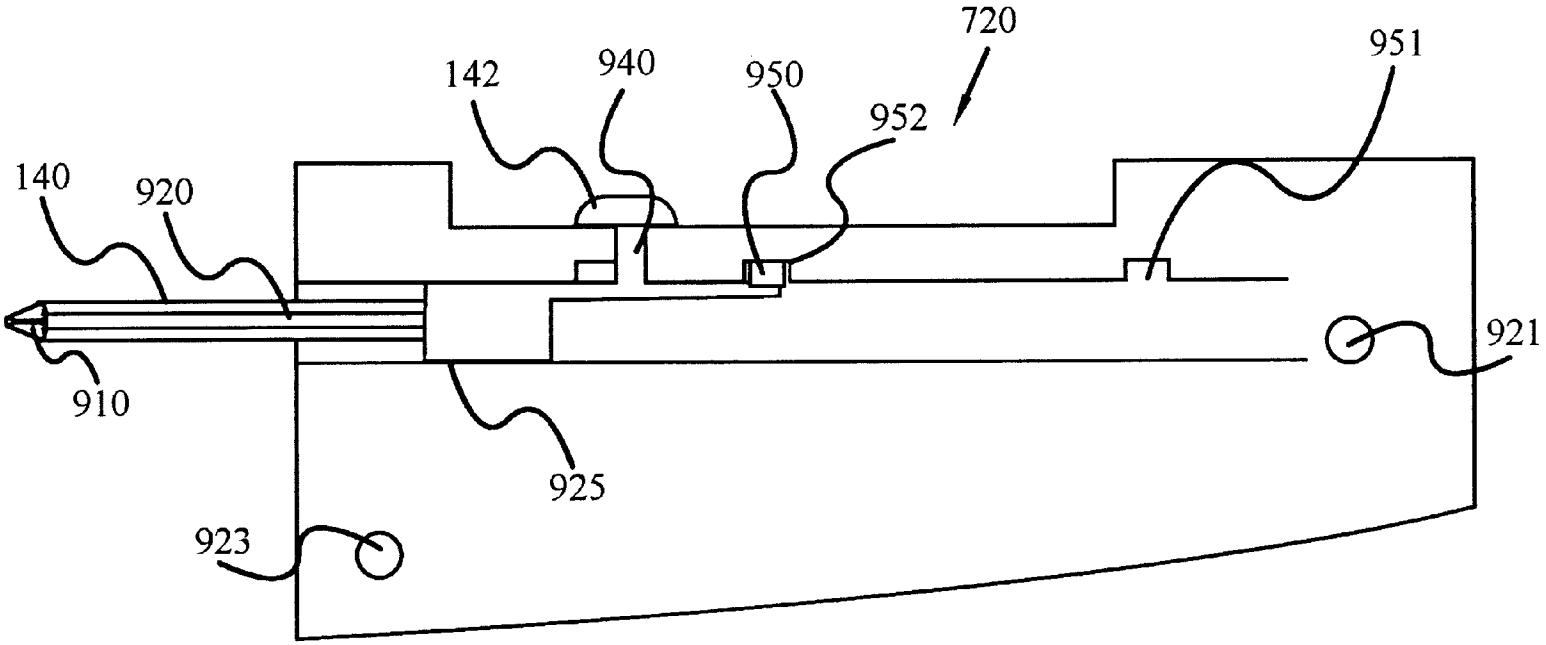
FIG. 9 is a view of the screw driver assembly.

Referring now to FIG. 9 the screwdriver assembly 900 and the second handle portion 124 is further illustrated. As described above, the second handle portion 124 includes screw holes 921, 923. The screwdriver 140 includes a screwdriver tip 910 and a screwdriver barrel 920. The barrel 920 engages socket 925, in which the screwdriver 140 is retained. The barrel 920,may be formed integrally with the socket 925, or may be affixed to it using a variety of means, such as adhesives, screws, welding, or rivets. The socket 925 attaches to a flange 930. The flange 930 includes a prong 950 and a stem 940. The second button 142 extends from the stem 940. When the second button 142 is depressed the force downwards extends through the stem 940 to the flange 930, causing the flange 930 to bend downwards. The flange 930 may be constructed of a material similar to the flange 830 used in the cutting edge assembly 800. When the second button 142 is pressed downwards, the force transmitted through the stem 940 to the flange 930 causes the prong 950 to extend downwards. When the prong 950 is forced downwards, the screwdriver assembly 900 may be slid along the length of the handle 120 within the second handle portion 124. A first recess 951 and a second recess 952 are included integrally with the second handle portion 124. When the prong 950 engages the first recess 951, the screwdriver assembly 900 is retracted within the handle 120. Whenever the prong 950 engages the second recess 952, the screwdriver 140 extends from the pounding surface 150 of the handle 120 for use.

What is claimed is:

1. A multi-use knife comprising:

a handle comprising a first end and an opposing second end;

a broad blade rigidly affixed at the first end of the handle;

a heel assembly comprising:

a pounding surface at the second end of the handle opposite from the broad blade; and at least one heel extension extending longitudinally from the pounding surface into the handle to rigidly affix the pounding surface to the second end of the handle;

a screwdriver slidably mounted within the handle, the screw driver selectively extendable and retractable through the pounding surface; and a cutting edge slidably mounted within the handle, the cutting edge selectively extendable and retractable through the pounding surface.

2. The multi-use knife of claim 1 further comprising:

a first depressable button fixedly connected to the screwdriver; and a second depressable button fixedly connected to the cutting edge.

3. The multi-use knife of claim 2, wherein the handle further comprises:

a first half;

a second half;

a blade extension; and a plurality of screws to detachably secure the first half, the second half, the at least one heel extension, and the blade extension together such that the blade extension and the at least one heel extension overlap one another and are contained between the first half and the second half.

4. The multi-use knife of claim 3, wherein the broad blade comprises a four inch blade.

5. The multi-use knife of claim 3 wherein the broad blade comprises a six inch blade.

6. The multi-use knife of claim 3 wherein the broad blade comprises a two inch blade.

7. A multi-use knife comprising:

a broad blade assembly comprising:

a broad blade; and a blade extension extending longitudinally from the broad blade; a heel assembly comprising:

a pounding surface opposite from the broad blade; and first and second heel extensions extending longitudinally from the pounding surface;

a handle assembly between the broad blade and the pounding surface, the handle assembly comprising:

a first handle portion; and a second handle portion;

wherein the first and second handle portions, the first and second heel extensions, and the blade extension are detachably secured together such that the blade extension is contained between the first and second heel extensions and the first and second heel extensions are contained between the first and second handle portions;

a screw driver assembly comprising a screwdriver slidably mounted within the first handle portion, the screw driver selectively extendable and retractable through the pounding surface; and a razor blade assembly comprising a razor blade slidably mounted within the second handle portion, the razor blade selectively extendable and retractable through the pounding surface.

8. The multi-use knife of claim 7, the screw driver assembly further comprising:

a socket within the first handle portion into which the screwdriver is retained; and a flexible flange extending from the socket opposite the screwdriver, the flexible flange comprising:

a prong within the first handle portion for selectively engaging with the first handle portion;

a stem extending through the first handle portion; and a depressable button extending from the stem.

9. The multi-use knife of claim 8, wherein the first handle portion comprises:

a plurality of internal prong recesses with which the prong selectively engages; and an external button slide recess in which the depressable button is slidably and depressably located.

10. The multi-use knife of claim 7, the razor blade assembly further comprising:

a flexible flange attached to the razor blade, the flexible flange comprising:

a prong within the second handle portion for selectively engaging with the second handle portion;

a stem extending through the second handle portion; and a depressable button extending from the stem.

11. The multi-use knife of claim 10, wherein the second handle portion comprises:

a plurality of internal prong recesses with which the prong selectively engages; and an external button slide recess into which the depressable button is slidably and depressably located.

12. The multi-use knife of claim 7, wherein the heel assembly further comprises a nub extending longitudinally from the pounding surface, and wherein the second handle portion comprises a notch that engages the nub to retain the second handle portion.

13. The multi-use knife of claim 7, wherein the broad blade is selected from the group consisting of a two inch blade, and four inch blade, and a six inch blade.

* * * * *